United States Patent [19]

Schutz

[11] Patent Number: 4,859,518

[45] Date of Patent: Aug. 22, 1989

[54] FOLDED SHEET PRODUCT

[75] Inventor: Rudolph W. Schutz, Walnut Creek, Calif.

[73] Assignee: James River Corporation, Richmond, Va.

[21] Appl. No.: 247,672

[22] Filed: Sep. 22, 1988

[51] Int. Cl.[4] ..... B32B 3/04

[52] U.S. Cl. ..... 428/126; 428/130; 221/47; 206/494

[58] Field of Search ..... 221/47, 48, 63; 428/126, 130; 206/491, 494

[56] References Cited

U.S. PATENT DOCUMENTS

| | | | |
|---|---|---|---|
| 1,177,466 | 3/1916 | Winter . | |
| 1,501,662 | 7/1924 | Horwitt . | |
| 1,681,369 | 9/1924 | Hansen . | |
| 1,698,823 | 1/1929 | Rasmussen . | |
| 1,706,166 | 3/1929 | Hunt . | |
| 1,962,762 | 6/1934 | Campbell | 206/57 |
| 2,009,464 | 7/1935 | Winter | 206/57 |
| 2,244,630 | 6/1941 | Metternich | 206/57 |
| 2,477,223 | 7/1949 | West | 206/57 |
| 3,007,605 | 11/1961 | Dearwester | 221/47 |
| 3,047,141 | 7/1962 | Burns | 206/57 |
| 3,119,516 | 1/1964 | Donovan | 221/47 |
| 4,143,762 | 3/1979 | Spiegelberg | 206/210 |
| 4,623,074 | 11/1986 | Dearwester | 221/48 |

*Primary Examiner*—Alexander S. Thomas

*Attorney, Agent, or Firm*—Thomas R. Lampe; Glen R. Grunewald

[57] ABSTRACT

A folded sheet product having two terminal portions with free edges midway of the paper product and having a substantially uniform thickness across the full extent thereof when folded.

5 Claims, 1 Drawing Sheet

FOLDED SHEET PRODUCT

TECHNICAL FIELD

The present invention relates, in general, to a folded product constructed from a unitary sheet (which may be single or multiple ply) and adapted for dispensing from a dispenser cabinet. The preferred embodiment of the invention disclosed herein relates to a towel, but it is to be understood that the principals of the invention may be applied to other types of products such as napkins. The products may be constructed of paper, nonwoven materials, or any other suitable material.

BACKGROUND ART

A wide variety of towels, napkins, and the like are known in the prior art. For example, a patentability search conducted relative to the present invention located the following U.S. Pat. Nos: 3,007,605, 3,047,141, 2,447,223, 1,698,823, 1,777,466, 4,143,762, 3,119,516, 1,962,762, 1,681,639, 1,706,166, 4,623,074, 2,224,630, 2,009,464, and 1,501,662.

Not disclosed in the above-identified patents, but well known in the prior art are two additional folded towel configurations which are identified hereinafter as prior art and are described herein.

The folded sheet product according to the present invention incorporates a specific construction not shown in the prior art which has numerous advantages. In particular, the product comprising the present invention has features which make it particularly applicable for use with conventional dispensing cabinets.

Many prior art towels and the like must be loaded into a cabinet with a specific side of the towel disposed downwardly and a specific side thereof disposed upwardly. Also, prior art constructions can have specific "right" ends and "left" ends. If the towels are placed in the dispenser cabinet upside down or with the ends thereof reversed, they cannot readily be dispensed through the conventional slot arrangement extending across the bottom of the cabinet. The sheet product of the present invention, on the other hand, has no "upside" or "downside" and no specific "right" end or "left" end, and the product may be loaded in the cabinet with either side up or down and with its ends oriented either way. Also, as contrasted to some of the more commonly utilized prior art arrangements, the sheet product of the present invention dispenses better because it is essentially self-opening as it is pulled from the cabinet.

The sheet product of the present invention has a configuration which also has a number of advantages over the prior art approaches with regard to the packaging and shipping thereof. It is common practice to stack and band a plurality of paper towels or like products together as a package for shipment and storage prior to use. Packages of the sheet product constructed in accordance with the teachings of the present invention hold their shape better than packages of conventional prior art towels even when tightly compressed in packaging. Further, packages of sheet products constructed in accordance with the teachings of the present invention require less space than commonly used prior art products even though the sheet products themselves are exactly the same size when unfolded.

DISCLOSURE OF THE INVENTION

According to the teachings of the present invention, a folded sheet product, such as a towel or napkin, is constructed from a unitary sheet, which may be single or multi-ply, and adapted for dispensing from a dispenser cabinet of conventional construction.

The product has a specific configuration when folded and includes rectangular-shaped terminal portions or tails on both sides thereof. The terminal portions each have a first free edge, the edges being in general registry at a location substantially midway of the product. Such an arrangement enables the sheet product to be loaded into a dispenser cabinet with either terminal portion disposed downwardly toward the cabinet dispenser slot.

The product of the present invention additionally comprises first and second intermediate portions which meet at a fold line generally in registry with the free edges. Thus, the folded sheet product has a substantially uniform thickness. This facilitates packaging, transport, and storage of a stack of the subject products. Many prior art paper towels and the like, by contrast, do not have a uniform thickness when folded. Often packages of such prior art products have a "soft center" which results in a larger package and a package that does not hold its shape well. Packages of the towels or napkins of the present invention are structurally stable and hold their shape well even when the products are tightly banded or otherwise compressed by packaging.

Other features, advantages, and objects of the present invention will become apparent with reference to the following detailed description and accompanying drawings.

BEST MODE FOR CARRYING OUT THE INVENTION

Figure 1:
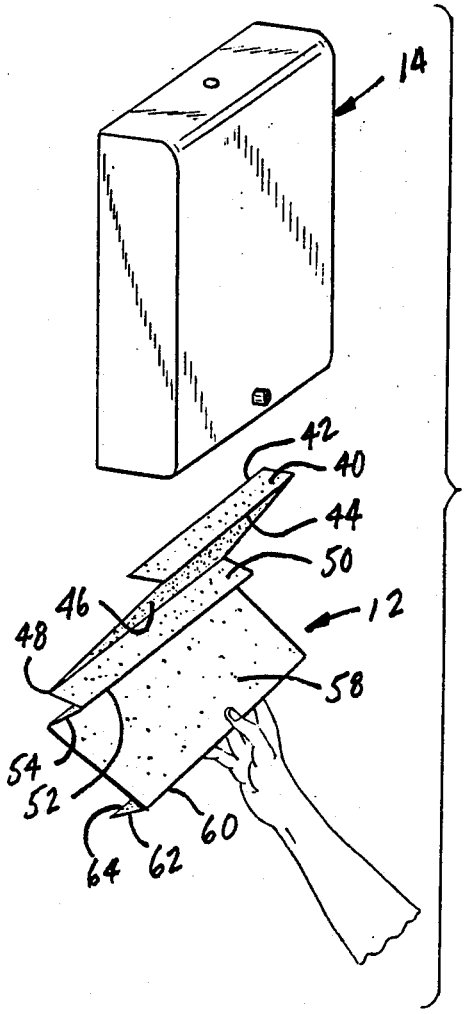
FIG. 1 is a perspective view of a paper towel constructed in accordance with the teachings of the present invention just subsequent to its removal from a towel cabinet.
Figure 2:
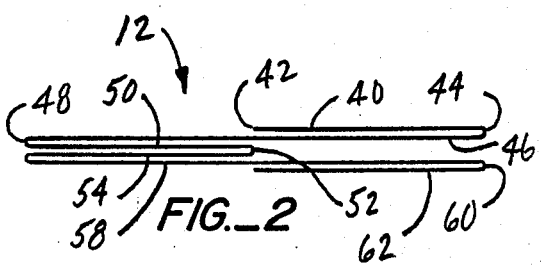
FIG. 2 is a schematic, side view of the paper towel of FIG. 1 illustrating the towel in folded condition.

FIGS. 1 and 2 illustrate a preferred embodiment of the present invention; namely, a paper towel 12. In FIG. 1, a paper towel 12 is illustrated just after it has been manually withdrawn from a cabinet 14. Cabinet 14 is of conventional construction and forms no part of the present invention. As is conventional, the cabinet is adapted to contain a plurality of stacked towels above a dispensing slot (not shown) extending across the bottom of the cabinet. Towels are adapted to be removed seriatim from the slot by users.

Figure 2A:
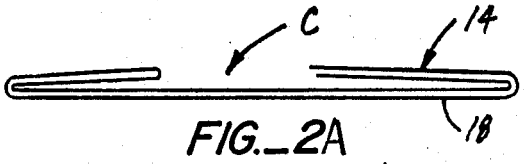
FIG. 2A (PRIOR ART)
FIGS. 2A and 2B are views similar to FIG. 2, but illustrating two alternate forms of paper towels which are in current widespread usage.
Figure 2B:
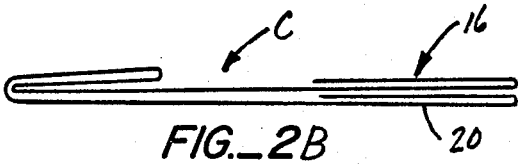
FIG. 2B (PRIOR ART)

FIGS. 2A and 2B illustrate in schematic fashion prior art folded towel constructions which are now in widespread usage. The towel illustrated in FIG. 2A is generally refereed to in the trade as a "C-Fold" towel. The C-Fold towel is generally designated by reference numeral 14. The towel of FIG. 2B is generally known in the trade as a "Twin C-Fold" towel, such towel being generally identified by reference numeral 16.

Prior art towels 14 and 16 must be loaded into a dispenser cabinet in a certain way in order for the towels to be dispensed therefrom. In other words, there is a distinct top side and bottom side. It is to be noted that both the C-Fold towel 14 and the Twin C-Fold towel 16 have sides (sides 18, 20 respectively) which progress across the full extent of the towel. Towels 14 and 16 should not be inserted into a cabinet having a dispensing slot with sides 18 and 20 disposed downwardly as shown since no towel tail or terminal portion would be positioned for access at the cabinet's downwardly directed dispensing slot. It is not at all uncommon, however, for the C-Fold and the Twin C-Fold towels to be so improperly loaded into the cabinet. This simply means that a prospective user cannot obtain a towel at all or must expend a great deal of time and energy to do so by reaching into the slot and attempting to grasp the towel inside the cabinet. This can result in injury as well as towel waste.

Another problem with the prior art towels of FIGS. 2A and 2B is that they do not have a uniform thickness across th entire paper product. For example, towel 14, at the center "C" thereof has a two-layer thickness while the extremities of the towel have a four-layer thickness. The same is true of towel 16.

Figure 3A:
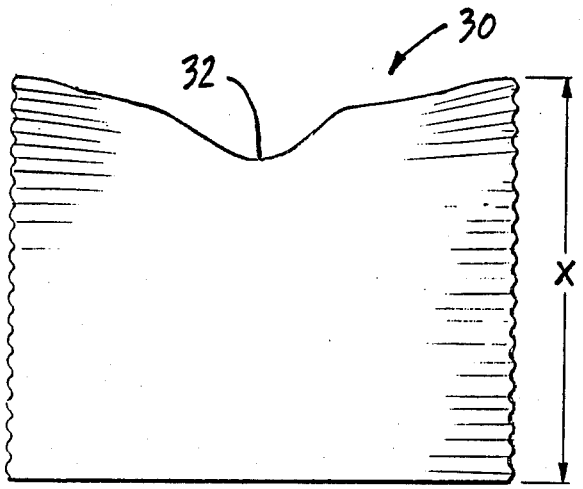
FIG. 3A (PRIOR ART)
FIG. 3A is a view similar to FIG. 3, but illustrating schematically the stack configuration assumed by a plurality of prior art towels.

One of the problems which results from a two-ply center and four-ply end construction is illustrated in FIG. 3A. FIG. 3A illustrates a stack 30 of towels which may be of the type shown in either FIG. 2A or FIG. 2B. The stack or package 30 has what is known as a "soft center" resulting from the fact that there is less material in the center of each folded towel. This results in formation in the stack of a depression 32. In addition, the height of the stack or package 30 at the ends thereof has a height X which is significantly greater than such dimension would be if the towels in stack 30 were uniform across each of said paper products. The "soft center" makes it not only difficult to form and wrap a stack of towels but any final package does not hold its shape very well, especially when the stack is merely banded as is often the case.

The towel constructed in accordance with the teachings of the present invention will now be described. It will be readily apparent that the components of towel 12 cooperate in such a manner as to obviate the problems encountered by prior art constructions.

Towel 12 includes a first rectangular-shaped terminal portion 40 defined by a first free edge 42 and a first fold line 44 spaced from said edge and substantially parallel thereto.

A first primary portion 46 underlies the first terminal portion and extends from the first fold line to a second fold line 48 substantially parallel to the first fold line.

A first intermediate portion 50 underlies the first primary portion and extends from the second fold line to a third fold line 52, said third fold line, when said towel is folded, being generally in registry with the first free edge 42.

A second intermediate portion 54 underlies the first intermediate portion and extends from the third fold line to a fourth fold line 56, the fourth fold line being generally in registry with th second fold line and said first intermediate portion and said second intermediate portion being in substantially superposed relationship when the towel is folded as shown in FIG. 2.

A second primary portion 58 underlies the second intermediate portion and extends from the fourth fold line to a fifth fold line 60. Fifth fold line 60 is substantially parallel to the fourth fold line and, when the towel is folded, is in general registry with the first fold line 44.

A rectangular-shaped second terminal portion 62 is defined by fifth fold line 60 and a second free edge 64. When the towel is folded as shown in FIG. 2 the first and second terminal portions are in substantially superposed relationship with the free edges thereof in general registry with each other and with third fold line 52.

It will be noted that the folded towel 12 has a substantially uniform thickness thereacross. This means that a stack of towels 12 will not have a "soft center". The terminal portions of towel 1 and the intermediate portions thereof have substantially the same configuration whereby the free edges and the third fold line are in general registry at a location substantially midway of the towel.

Figure 3:
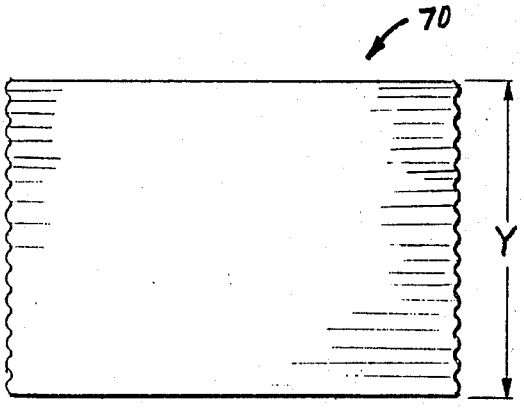
FIG. 3 is a schematic elevation illustrating a stack of folded towels constructed in accordance with the teachings of the present invention.

FIG. 3 illustrates schematically the general overall configuration of a stack or bundle 70 of towels 12. As noted, the stack has no "soft center"; therefore, the entire stack has a generally rectangular-shaped configuration as viewed from the side, a configuration which more readily lends itself to packaging and handling. The stack 70 is of generally uniform height across the extent thereof. Further, a stack of the type shown in FIG. 3 is much more stable than a stack of the type illustrated in FIG. 3A. It should also be noted that stack 70, assuming the same number of towels therein, has a stack height Y which is much less than the stack height X of stack 30. This is quite advantageous since more stacks of towels Y may be stored or shipped in a given volume of space than stacks 30 of prior art towels.

First terminal portion 40 and second terminal portion 62, of course, constitute tails or free ends which may be readily grasped by a user through a dispensing slot of a dispensing cabinet. Thus, there is no correct "upside" or "downside" and towels 12 may be stacked with either of the terminal portions disposed at the slot location.

Another advantage of the towel 12 over the prior art towels of FIGS. 2A and 2B is that towel 12 is virtually self-opening as it is pulled out through a dispensing slot. This feature may be seen with reference to FIG. 1. The towel configurations of FIGS. 2A and 2B, on the other hand, require special manual manipulation to open them fully.

I claim:

1. A -folded sheet product constructed from a sheet and adapted for dispensing from a dispenser cabinet, said product comprising, in combination:

a first rectangular-shaped terminal portion defined by a first free edge and a first fold line spaced from said first free edge and substantially parallel thereto;

a first primary portion underlying said first terminal portion and extending from said first fold line to a second fold line substantially parallel to said first fold line;

a first intermediate portion underlying said first primary portion and extending from said second fold line to a third fold line, said third fold line being generally in registry with the first free edge;

a second intermediate portion underlying said first intermediate portion and extending from said third fold line to a fourth fold line, said fourth fold line being generally in registry with said second fold line, said first intermediate portion an said second intermediate portion being in substantially superposed relationship;

a second primary portion underlying said second intermediate portion and extending from said fourth fold line to a fifth fold line substantially parallel to said fourth fold line, said fifth fold line being generally in registry with said first fold line; and a rectangular-shaped second terminal portion defined by said fifth fold line and a second free edge, said first and second terminal portions being in substantially superposed relationship with the free edges thereof in general registry with each other and with said third fold line.

2. The product according to claim 1 wherein said combination comprises a towel adapted for dispensing from a cabinet.

3. The product according to claim 1 wherein said portions cooperate to define a substantially uniform thickness across said paper product.

4. The product according to claim 1 wherein said terminal portions and said intermediate portions have substantially the same configuration whereby the free edges and the third fold line are in general registry at a location substantially midway of said paper product.

5. A stack of product as set forth in claim 1 and having a substantially rectangular cross section and generally uniform height across the extent thereof.

* * * * *